US005860375A

United States Patent [19]

Williams

[11] Patent Number: 5,860,375

[45] Date of Patent: Jan. 19, 1999

[54] DEVICE AND METHOD FOR MECHANICALLY HOOPING FABRIC ONTO EMBROIDERY HOOPS

[76] Inventor: Ely Williams, P.O. Box 349, Fayette, Ala. 35555

[21] Appl. No.: 915,042

[22] Filed: Aug. 20, 1997

[51] Int. Cl.[6] ..... D06F 3/08

[52] U.S. Cl. ..... 112/103; 38/102.2

[58] Field of Search ..... 112/103; 38/102.2, 38/102.91; 100/269.18, 212, 237, 275, 274, 276

[56] References Cited

U.S. PATENT DOCUMENTS

| | | | |
|---|---|---|---|
| 671,474 | 4/1901 | Essig . | |
| 682,271 | 9/1901 | Post . | |
| 887,403 | 5/1908 | Kohler . | |
| 928,598 | 7/1909 | Gibbs . | |
| 935,841 | 10/1909 | Fife . | |
| 955,415 | 4/1910 | Leonard . | |
| 989,597 | 4/1911 | Gibbs . | |
| 1,010,534 | 12/1911 | Totten et al. . | |
| 1,030,073 | 6/1912 | Gibbs . | |
| 1,093,136 | 4/1914 | Jucker et al. . | |
| 2,650,380 | 9/1953 | Eppler, Jr. | 100/237 X |
| 4,392,792 | 7/1983 | Rogers | 417/400 |
| 4,561,177 | 12/1985 | Rancer | 38/102.2 X |
| 4,644,629 | 2/1987 | Moore, III | 38/102.2 X |
| 4,774,778 | 10/1988 | Williams . | |
| 4,869,183 | 9/1989 | Moore, III | 112/103 |
| 4,981,092 | 1/1991 | Bauman et al. | 112/103 |
| 4,995,178 | 2/1991 | Randolph . | |
| 5,018,460 | 5/1991 | Schilling et al. . | |
| 5,113,611 | 5/1992 | Rosson . | |
| 5,129,171 | 7/1992 | Arbter et al. . | |
| 5,228,401 | 7/1993 | Moore, III . | |
| 5,327,827 | 7/1994 | Richardson . | |
| 5,413,057 | 5/1995 | Moore, III . | |
| 5,433,158 | 7/1995 | Moore, III . | |
| 5,555,828 | 9/1996 | Rowley . | |
| 5,590,613 | 1/1997 | Head . | |
| 5,664,350 | 9/1997 | Moore, III | 38/102.2 |

OTHER PUBLICATIONS

Embroidery Supply Warehouse 1996 catalog, pp. 42 and 43, published before 01 Aug. 1996 in the United States.

*Primary Examiner*—Ismael Izaguirre

*Attorney, Agent, or Firm*—Lanier Ford Shaver & Payne P.C.; Frank M. Caprio; Russell L. Sandidge

[57] ABSTRACT

The invention provides a mechanical hooping press for framing sections of fabric for embroidery machines. The press includes one or more cylindrical assemblies. The preferred embodiment provides at least two pneumatically-operated cylindrical assemblies being operable either in tandem or independently. The device provides a base having a recess, and with a cylindrical assembly positioned directly above the recess. A first ring of an embroidery hoop is placed in the recess and a fabric section is placed upon the first ring. The cylindrical assembly is provided with a hoop disk for detachably retaining the second ring of the embroidery hoop. The second ring is attached to the hoop disk and the hoop disk is then driven toward the recess, eventually driving the second ring into engagement with the first ring, and capturing the fabric section therebetween. The invention also provides a nested hoop disk, and an embroidery hoop especially adapted for use with the mechanical hooper.

22 Claims, 7 Drawing Sheets

DEVICE AND METHOD FOR MECHANICALLY HOOPING FABRIC ONTO EMBROIDERY HOOPS

BACKGROUND

Modern embroidery machines typically have multiple sewing heads. Each of these heads can embroider a preselected design onto a section of fabric. Before the machine can embroider a given section of fabric, the fabric must be mounted onto an embroidery hoop, which is then attached to the machine. This mounting process is called hooping or framing the fabric. An embroidery hoop typically consists of an inner ring and an outer ring that fit snugly together, with the fabric section captured therebetween. The outer ring might include some adjustment means to adjust precisely the snugness of the fit between the inner and outer rings to compensate for the thickness of the fabric. After the fabric is hooped, the hoop can be attached to an embroidery machine for stitching.

Traditionally, the hooping process was performed manually. Manual hooping is slow and laborious, and with the increased competitiveness of the marketplace, eliminating manual labor has become a paramount objective. If an embroidery facility is using multiple-head embroidery machines, then it is critical to provide those machines with a steady flow of hooped fabric to maximize the throughput of embroidered items. Thus, if the hooping process is not performed quickly and efficiently, it can create a production bottleneck in the entire embroidery facility, thus reducing throughput, hampering production, and decreasing profits.

Also, manual hooping can inflict repetitive-stress injuries, such as carpal tunnel syndrome, upon the workers performing the manual hooping task. To manually hoop fabric, a worker must exert considerable force with the hands and arms to press the two rings together and capture the fabric. Exerting this force dozens or hundreds of times per shift can cause repetitive-stress injuries. In recent years, these repetitive-stress injuries have received increased attention from employers, insurers, and health care providers. The cost of treating these injuries, the cost of insurance and workers' compensation premiums, and the cost of worker downtime have motivated employers to take precautions to prevent their employees from suffering such injuries.

SUMMARY

One way to avoid repetitive stress injuries in the workplace is to eliminate repetitive, laborious tasks such as manual hooping in favor of automated processes that reduce the physical strain inflicted upon workers. Accordingly, a first objective of this invention is to provide an embroidery hooper that mechanizes the difficult, labor-intensive portions of the hooping process, leaving the worker to perform only relatively light tasks such as removing the hooped fabric from the press.

A second objective of the invention is to provide a device and process that mechanically presses the inner ring and the outer ring of an embroidery hoop together while capturing a section of fabric therebetween.

A third objective is to provide a light, compact, portable hooping press. The press embodying the instant invention weighs approximately eighty-five pounds.

The instant invention provides a mechanical hooper and method for mechanically hooping one or more sections of fabric onto one or more embroidery hoops. The mechanical hooper can be either free-standing or mounted on a workbench. The hooper provides structure for supporting a first one of the rings and the fabric to be hooped. The hooper also provides structure for mounting one or more cylinder assemblies. These cylinder assemblies retain the second one of the rings and drive that second ring into engagement with the first ring. These cylinder assemblies also allow the second ring to detach from the retaining device after the second ring engages the first ring.

The cylinder assembly can include a cylindrical housing with a connecting rod passing through the housing. The cylinder assembly can be pneumatically operated, such that the connecting rod is driven by pumping air into, or extracting air from, the housing. A hoop disk is joined to the end of the connecting rod, and is used to retain the second ring of the embroidery hoop. The hoop disk is sized for a snug, frictional fit with that second ring, so that when the second ring is driven into engagement with the first ring, the second ring will readily detach from the hoop disk.

The hooper can include one or more cylinder assemblies, and these cylinder assemblies can be operated individually, or simultaneously to hoop two separate fabric sections at once. Also, where the hooper has two cylinder assemblies, a connecting bar can be attached to both assemblies to drive one hoop disk using both cylinder assemblies. Another embodiment provides an elongated or oblong hoop disk driven by both cylinder assemblies, which hoop disk is used to frame fabric onto non-round embroidery hoops.

The connecting rod and the cylinder housing are positioned coaxially, and are keyed together so that the connecting rod cannot rotate about its axis relative to the cylinder housing. Thus, the hooper prevents the hoop disk, which is attached to the connecting rod, from rotating and causing the first ring and the second ring to become misaligned during the hooping process. The connecting rod can have an octagonal, hexagonal, or other cross-sectional shape, or can include one or more splines running along its length. The aperture in the cylindrical housing through which the connecting rod passes is shaped to fit the cross-sectional profile of the connecting rod, thus keying the connecting rod tightly to the cylindrical housing.

The hoop disk includes an annular surface sized to fit the embroidery hoop. The hooper also provides a "nestable" hoop disk, which may be quickly fitted and removed from a hoop disk already attached to the connecting rod. The nestable hoop disk typically has an annular surface having a diameter different than that of the first hoop disk. With this nestable hoop disk, an operator can quickly configure the hooper to frame an run of fabric with differently-sized embroidery hoops.

The invention also provides an embroidery hoop specially adapted for use with the hooper. This embroidery hoop is a two-piece hoop having an inner ring and an outer ring. However, the inside upper corner of the outer ring, and the outside lower corner of the inner ring, are beveled to ease the mating of the two rings when the inner ring is driven into engagement with the outer ring. These beveled surfaces provide a greater margin of error between the registration of the inner and outer rings, thereby facilitating efficient mechanical hooping without damaging the inner and outer rings.

The method of the invention includes operating the cylindrical assemblies to retract the connecting rods, making the hoop disks and the recesses beneath the hoop disks accessible to the worker. The operator then selects an embroidery hoop to be framed onto a fabric section, and separates the embroidery hoop into an inner ring and an outer ring. The operator inserts the outer ring into the recess beneath the cylindrical assembly, and then places the fabric section upon the outer ring. The inner ring is then placed upon the hoop disk attached to the connecting rod. The hoop disk is sized to snugly fit the inner ring and retain it in place against the force of gravity. The operator then operates the cylindrical assembly to extend the connecting rod, driving the hoop disk and inner ring toward the recess in the base.

When the connecting rod nears the end of its travel, the hoop disk drives the inner ring into engagement with the outer ring, capturing the fabric section therebetween. Once the inner and outer rings are engaged, the friction between them is sufficient to overcome the frictional fit of the inner ring to the hoop disk. When the inner and outer rings are fully engaged, the operator operates the cylindrical assembly to retract the connecting rod. When the connecting rod withdraws, the inner ring detaches from the hoop disk, thus completing the hooping process. The operator then removes the hooped fabric section, and the above cycle is repeated to hoop the next fabric section. The method uses two tandem cylindrical assemblies to hoop two separate sections of fabric either individually or simultaneously. The two cylindrical assemblies can frame fabric with hoops having different sizes. This capability provides the invention with the versatility to handle standard embroidery hoops having sizes varying from #7 (60 mm) to #432 (420 mm by 170 mm). Finally, the method can nest two hoop disks together to provide a quick-change capability for short hooping runs with different sizes of embroidery hoops.

The instant invention can frame tubular hoops, which are typically used with finished, sewn garments rather than unfinished panels of fabric. Finished garments, such as shirts, are typically sewn into a tubular configuration, with two plies of fabric comprising the garment. Manually hooping such garments is laborious, with the operator slipping the outer ring of the tubular hoop between the two plies of fabric, adjusting the garment relative to the outer ring, adjusting the inner ring relative to the garment and the outer ring, and finally pressing the inner ring into engagement with the outer ring. With the instant invention, the base of the press can be spaced away from the work surface, allowing the two plies of the garment to fit above and below the base. The outer ring is placed into the recess, effectively pre-aligning it with the inner ring, which is mounted on the hoop disk. Then, the operator need only slide the garment over the base, with the top ply passing over the recess and the outer ring, and with the lower ply fitting beneath the base. Thus, using the instant invention with tubular hoops cuts labor costs considerably.

DETAILED DESCRIPTION OF THE PREFERRED EMBODIMENT

Figure 1:
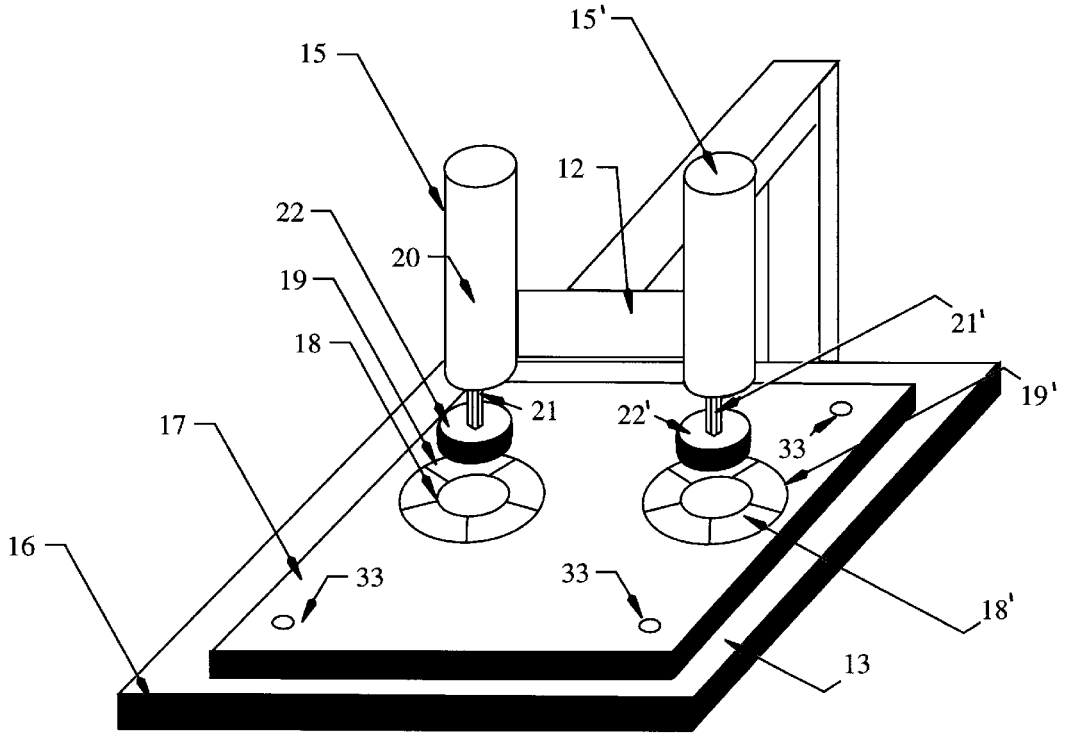
FIG. 1 is a perspective view of the preferred embodiment of mechanical embroidery hooper 10.

FIG. 1 is a perspective view of the preferred embodiment of mechanical embroidery hooper 10, which includes mounting frame 12 and substrate 16. Mounting frame 12 supports two cylinder assemblies 15 and 15', although more or fewer cylinder assemblies 15 could be supported as needed. Mounting frame 12 preferably includes a vertical upright and a T-shaped, horizontally-disposed member, to which cylinder assemblies 15 and 15' attach, but could have several equivalent configurations, such as having two separate uprights rather than one.

Substrate 16 is preferably planar, and base 17 is joined to substrate 16 by bolts 33. Substrate 16 is preferably formed of steel, while base 17 may be formed from wood or other readily machined material. Base 17 defines recesses 19 and 19', which can be cut or machined to selected shapes and sizes. The advantage of this configuration is that a plurality of bases 17 having differently sized and shaped recesses 19 and 19' can be kept on hand and installed onto substrate 16 as necessary.

Recesses 19 and 19' provide the preferred means for securing the rings of the embroidery hoop to base 17. Alternative means might include raised tabs, magnetic holding structures, or other suitable securing means. Recesses 19 and 19' hold spiders 18 and 18', which are adapters that allow base 17 to work with embroidery hoops of different sizes by replacing spiders 18 and 18' rather than base 17.

Spiders 18 and 18' are inserted into recesses 19 and 19', respectively. It should be understood that spiders 18 and 18' are comparable; thus, the descriptions of spider 18 apply equally to spider 18'. Spider 18 is mated with an embroidery hoop (not shown in FIG. 1) having a given size and shape. Typically, the embroidery hoop comprises an outer ring snugly engaging an inner ring. Spider 18 includes an outer portion for engaging the edges of recess 19, and an inner portion for engaging one of the rings of the embroidery hoop. Different spiders 18' having the same-sized outer portion can have differently-sized or differently-shaped inner portions. Spider 18' provides a further degree of flexibility in that several different spiders 18 can be used with the same base 17. Thus, a plurality of differently sized and shaped embroidery hoops can be used without replacing base 17. The operator simply inserts differently sized and shaped spiders 18 into recess 19. However, base 17 can be easily replaced if necessary by simply removing bolts 33.

Cylinder assemblies 15 and 15' are joined to mounting frame 12. It should be understood that cylinder assemblies 15 and 15' are comparable, and that the description of cylinder assembly 15 applies equally to cylinder assembly 15'. Cylinder assembly 15 includes cylinder housing 20, connecting rod 21, and hoop disk 22. Connecting rod 21 reciprocates relative to cylinder housing 20, and hoop disk 22 is removably attached to the end of connecting rod 21. Cylinder housing 21 is mounted normal to the plane of base 17 and directly above recess 19. Connecting rod 21, when extended, drives hoop disk 22 toward recess 19 in base 17. When connecting rod 21 is retracted, hoop disk 22 is readily accessible. Cylinder assembly 15 is the preferred means for driving hoop disk 22 toward base 17. Alternative driving means might include servomotors, stepper motors, devices operated by electromagnetic coils, motors driving threaded shafts, or other suitable driving means.

Hoop disks 22 and 22' having different shapes and sizes may be attached to cylinder assemblies 15 and 15'. This arrangement provides great flexibility by allowing the operator to simultaneously hoop multiple fabric sections with different types of hoops.

The two cylinder assemblies 15 and 15' can be mounted in tandem upon mounting frame 12. A pair of switches (not shown in FIG. 1) controls the operation of the individual cylinder assemblies 15 and 15', so that the operator can choose whether to operate both cylinder assemblies 15 and 15', or one cylinder assembly 15 only. Thus, mechanical embroidery hoop 10 can simultaneously hoop one or more sections of fabric. This capability is especially useful when framing embroidery hoops onto different parts of the same piece of fabric, such as pants legs or shirt sleeves.

The method of using the preferred embodiment of mechanical embroidery Hooper 10 will now be explained with reference to FIG. 1. The operator activates cylindrical assembly 15 to retract connecting rod 21, making hoop disk 22 and recess 19 beneath hoop disks 22 accessible to the operator. If spider 18 is to be used, the operator places it into recess 19. Embroidery hoop 23 is separated into inner ring 27 and outer ring 24. The operator inserts outer ring 24 into recess 19, or into spider 18, beneath cylindrical assembly 15, and then places the fabric section (not shown) upon outer ring 24. Inner ring 27 is then placed upon hoop disk 22 attached to connecting rod 21. Hoop disk 22 is sized to snugly fit inner ring 27 and retain it in place against the force of gravity. The operator then activates cylindrical assembly 15 to extend connecting rod 21, driving hoop disk 22 and inner ring 27 toward recess 19 in base 17.

When connecting rod 21 nears the end of its travel, hoop disk 22 drives inner ring 27 into engagement with outer ring 24, capturing the fabric section therebetween. Once the inner and outer rings are engaged, the friction between them is sufficient to overcome the frictional fit of inner ring 27 to hoop disk 22. When the inner and outer rings are fully engaged, the operator operates cylindrical assembly 15 to retract connecting rod 21. When connecting rod 21 withdraws, inner ring 27 detaches from hoop disk 22, thus completing the hooping process. The operator then removes the hooped fabric section, and the above cycle is repeated to hoop the next fabric section.

Figure 6:
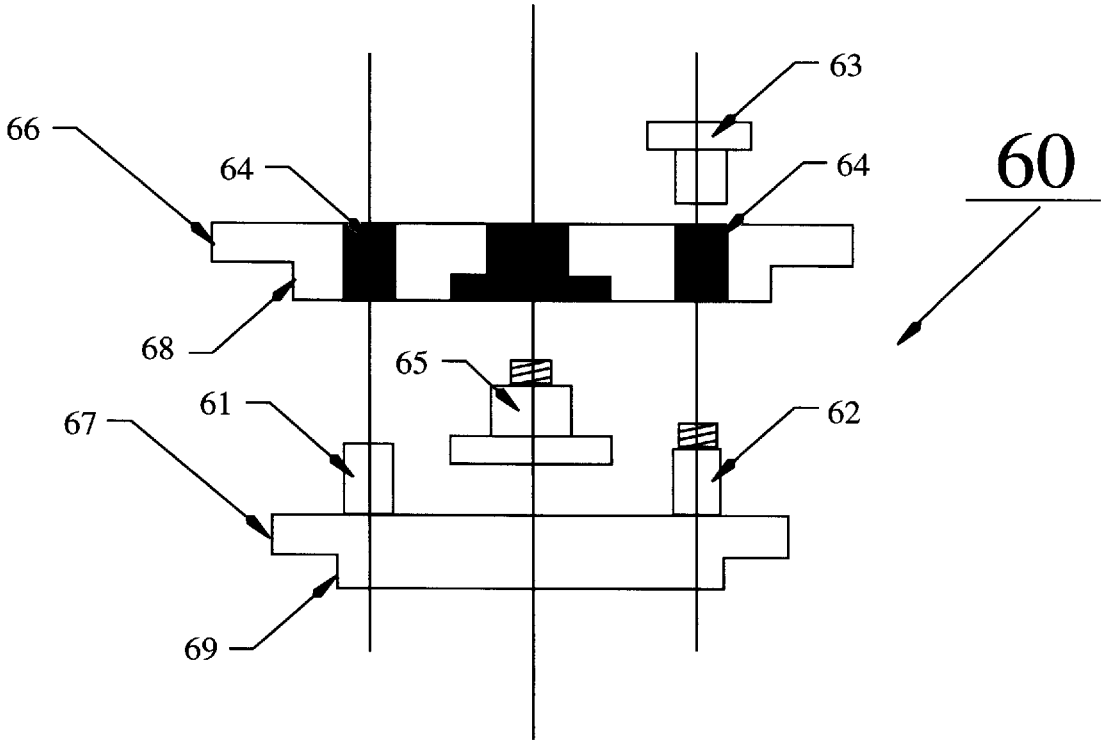
FIG. 6 is an exploded, side elevational view of an embodiment of nested hoop disk assembly 60, which is an alternative embodiment of hoop disk 22.
Figure 7:
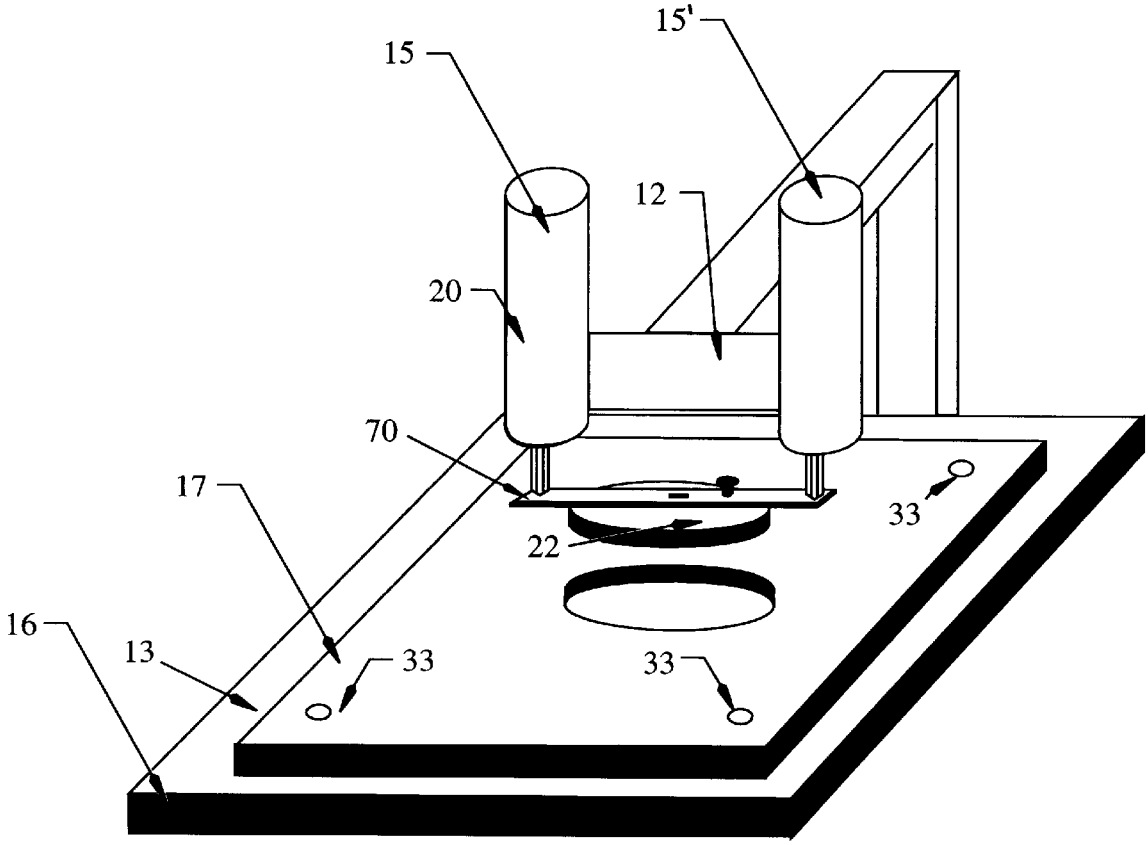
FIG. 7 is a perspective view of an alternative embodiment of mechanical embroidery hooper 10.
Figure 8:
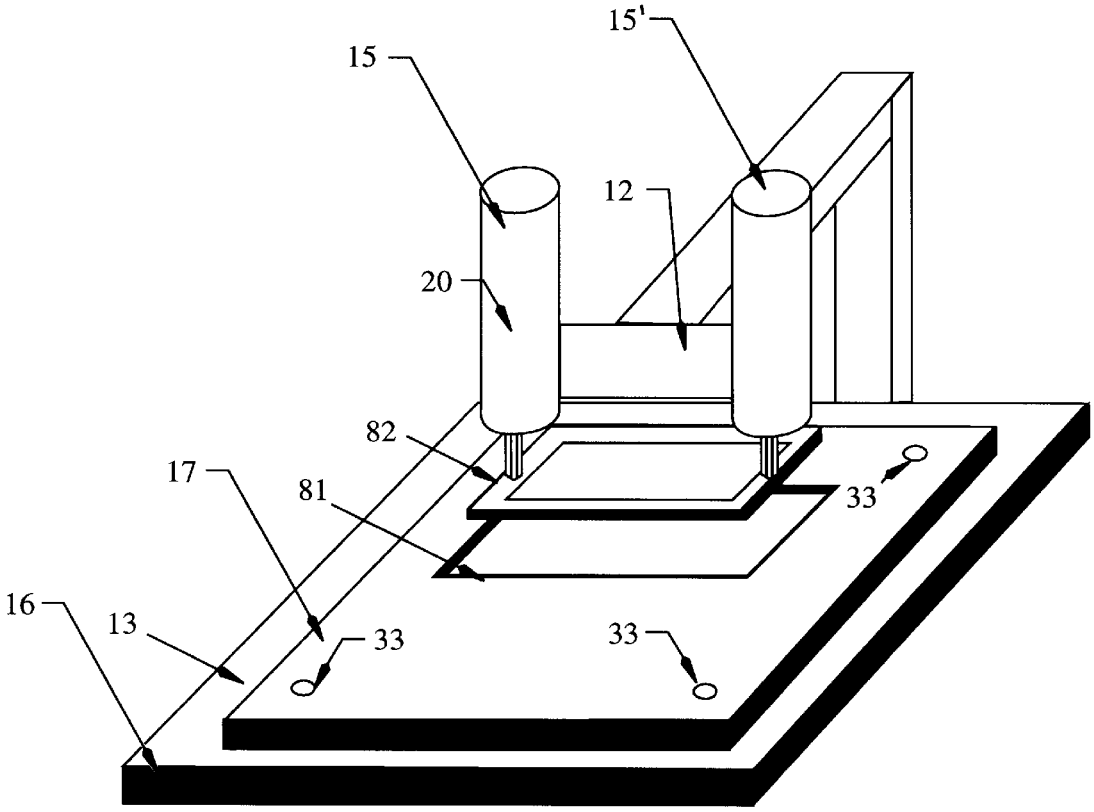
FIG. 8 is a perspective view of another alternative embodiment of mechanical embroidery hooper 10.

The method can use two tandem cylindrical assemblies 15 and 15' to hoop two separate sections of fabric either simultaneously or individually. Also, the two cylindrical assemblies 15 and 15' can frame fabric with embroidery hoops 23 of different sizes. With reference to FIG. 6, the method can nest two hoop disks 66 and 67 together to provide a quick-change capability for short hooping runs with different sizes of embroidery hoops 23. With reference to FIG. 7, the method can provide for attaching connecting bar 70 to both cylindrical assemblies to allow both assemblies to drive one hoop disk 22. With reference to FIG. 8, an elongated hoop disk 82 can be attached to both cylindrical assemblies so that the assemblies distribute driving force equally to both sides of elongated hoop disk 82. These alternate methods will be discussed in more detail below.

Figure 2:
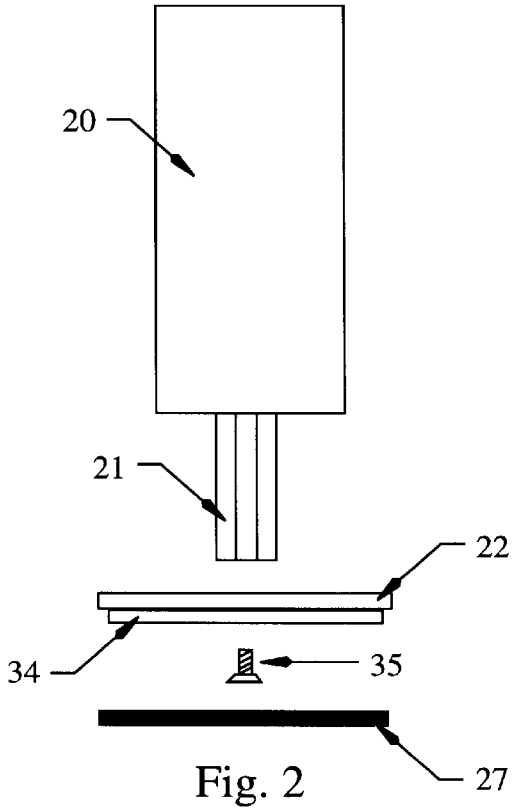
FIG. 2 is a side elevational view of cylinder assembly 15.

FIG. 2 is a side elevational view of cylinder assembly 15. Cylinder assembly 15 is preferably pneumatically-operated, and is joined to a pneumatic control system (not shown in FIG. 2) that selectively extends and retracts connecting rod 21. Bolt 35 secures hoop disk 22 to the end of connecting rod 21 by engaging an internally-threaded bore drilled axially into connecting rod 21. The shape of hoop disk 22 matches the shape of inner ring 27, and the shape of inner ring 27 corresponds to the shape of outer ring 24 as placed in recess 19. When inner ring 27 and outer ring 24 are round, the rotational alignment between hoop disk 22 and connecting rod 21 is not critical. However, where inner ring 27 and hoop disk 22 are not round, hoop disk 22 can be rotated relative to connecting rod 21 as necessary properly to align hoop disk 22 with spider 18 and recess 19 Once hoop disk 22 has been properly positioned, it can be secured in place by tightening bolt 35. Also, hoop disk 22 can be readily removed by unthreading bolt 35. Hoop disk 22 includes annular surface 34, which frictionally engages inner ring 27, which is described with reference to FIG. 3. Hoop disk 22 and annular surface 34 provide means for detachably retaining inner ring 27.

Figure 3:
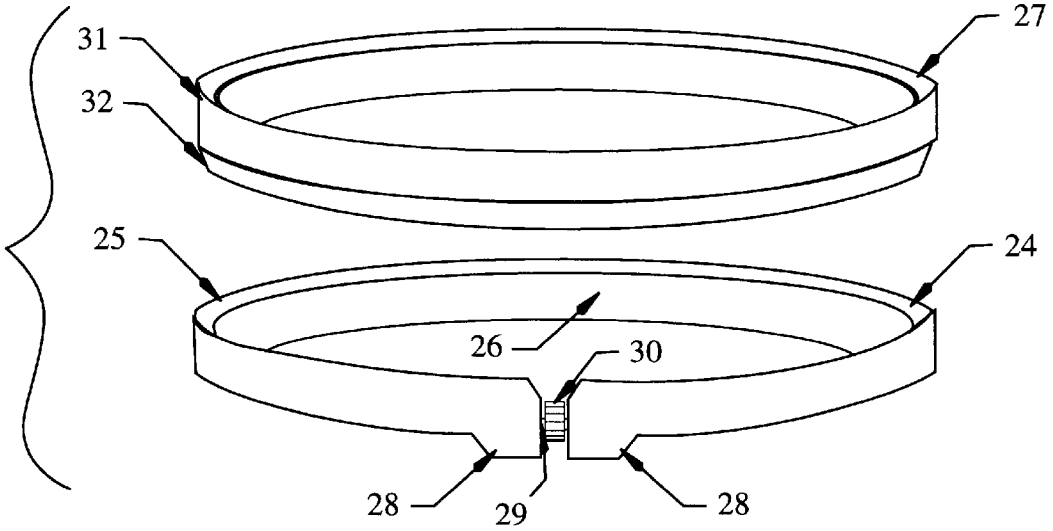
FIG. 3 is a perspective, exploded view of embroidery hoop 23.

FIG. 3 is a perspective, exploded view of embroidery hoop 23, which comprises inner ring 27 and outer ring 24. Inner ring 27 and outer ring 24 are preferably manufactured from flexible plastic that can deform slightly without permanently distorting.

The circumference of inner ring 27 is fixed. Inner ring 27 includes vertical mating surface 32, which engages outer ring 24, and beveled surface 32. Inner ring 27 should be oriented above outer ring 24 so that beveled surface 32 engages outer ring 24.

The circumference of outer ring 24 is adjustable. Outer ring 24 includes two raised portions 28, and member 29 threads into both raised portions 28. Member 29 includes knob 30 so that member 29 can be readily rotated by hand. As member 29 is threaded in one direction, the threads pass further into raised portions 28 to decrease the circumference of outer ring 24. As member 29 is threaded in the opposite direction, the threads withdraw from raised portions 28 to increase the circumference of outer ring 24.

Outer ring 24 includes vertical mating surface 26, which engages inner ring 27, and beveled surface 25. Outer ring 24 should be oriented below inner ring 27 so that beveled surface 25 engages inner ring 27. Beveled surfaces 25 and 32 ease the mating of inner ring 27 with outer ring 24 by "funneling" inner ring 27 into engagement with outer ring 24.

These beveled surfaces are especially helpful in the context of mechanical, as opposed to manual hooping. In manual hooping, the worker can precisely adjust the inner and outer rings for a perfect fit. In mechanical hooping, the press must position the rings precisely. If outer ring 24 and inner ring 27 lacked beveled mating surfaces, then mechanical embroidery hooper 10 would have to register the two rings almost perfectly for it to press the two rings into engagement. The two beveled mating surfaces thus increase the margin for error and greatly facilitate high-speed, mechanical hooping operations.

Figure 4:
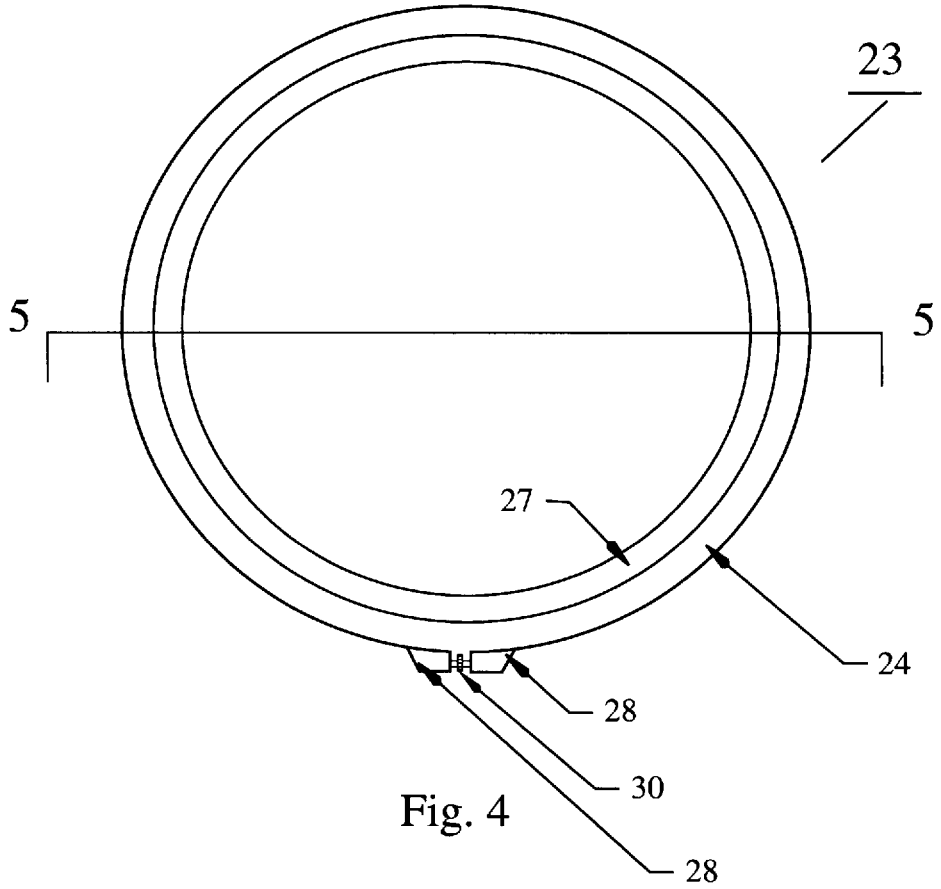
FIG. 4 is a top plan view of embroidery hoop 23 with inner ring 27 and outer ring 24 assembled.

FIG. 4 is a top plan view of embroidery hoop 23 with inner ring 27 and outer ring 24 assembled. For clarity, no fabric is shown, but it should be understood that a fabric section would be captured between inner ring 27 and outer ring 24. Knob 30 adjusts the circumference of outer ring 24 to snugly engage inner ring 27, while compensating for the thickness of any fabric hooped in embroidery hoop 23.

Figure 5:
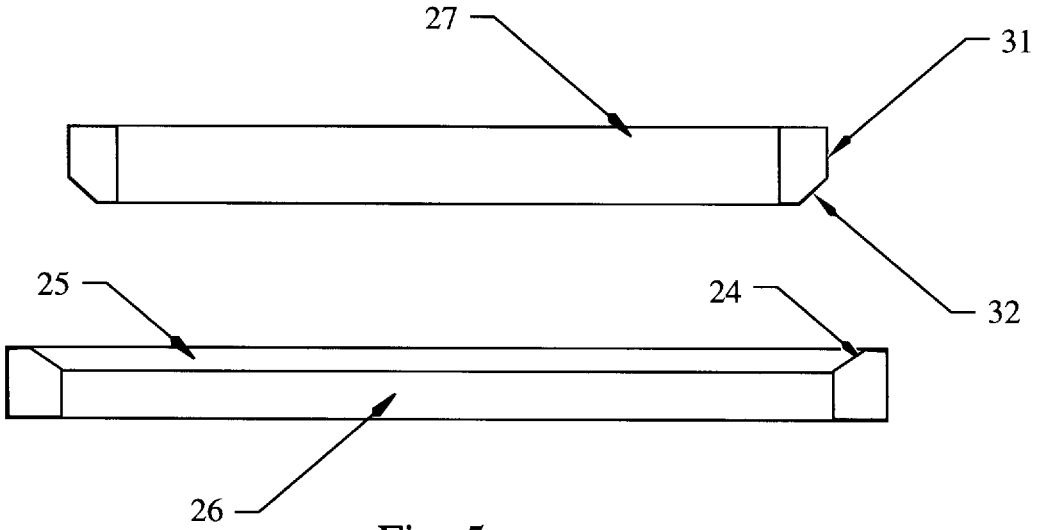
FIG. 5 is a cross-sectional view of embroidery hoop 23, taken along the line 5—5 in FIG. 4.

FIG. 5 is a cross-sectional view of embroidery hoop 23, taken along the line 5—5 in FIG. 4. FIG. 5 illustrates the positional relationship of outer ring 24 and inner ring 27. FIG. 5 also illustrates the alignment of vertical mating surfaces 26 and 31, and the alignment of beveled surfaces 32 and 25. Beveled surface 25 is on the upper inside corner of outer ring 24, while beveled surface 32 is on the lower outside corner of inner ring 27.

FIG. 6 is an exploded, side elevational view of an embodiment of nested hoop disk assembly 60, which is an alternative embodiment of hoop disk 22. Nested hoop disk assembly 60 includes upper hoop disk 66 and lower hoop disk 67.

Upper hoop disk 66 includes two apertures 64 and 64', which pass entirely through upper hoop disk 66. Annular surface 68 frictionally engages the inner ring of an embroidery hoop (not shown). Bolt 65 attaches upper hoop disk 66 to the end of connecting rod 21 in the same manner as bolt 35 attaches hoop disk 22 to connecting rod 21, as illustrated in FIG. 2. Bolt 65, when fully threaded into connecting rod 21, is recessed inside an aperture (shown in dashed outline in FIG. 6) defined by upper hoop disk 66, so that the exposed surface of bolt 35 is flush with the bottom surface of upper hoop 66.

Lower hoop disk 67 includes post 61 and threaded post 62, both of which project from the upper surface of lower hoop disk 67. The outer diameter of post 61 snugly engages the inner diameter of aperture 64', while threaded post 62 passes into aperture 64. Collar 63 screws onto the threaded portion of threaded post 62, and the outer diameter of collar 63 snugly engages the inner diameter of post aperture 64. Collar 63 preferably includes a recessed slot to allow a tool, such as a hex-driver or screwdriver, engage collar 63 to tighten it securely onto threaded post 62, thus attaching lower hoop disk 67 onto upper hoop disk 66.

Lower hoop disk 67 includes annular surface 69. As seen in FIG. 6, the diameter of annular surface 68 is different than that of annular surface 69. Thus, if only upper hoop disk 67 is attached to connecting rod 21, then mechanical embroidery hooper 10 can frame embroidery hoops having a circumference about the same as that of annular surface 68. However, if it becomes necessary to hoop a run of fabric sections with embroidery hoops having a different circumference, then the operator need only attach lower hoop disk 67 to upper hoop disk 66. After the run is finished, the operator can remove lower hoop disk 67, and return to hooping with upper hoop disk 66. This "nesting" of lower hoop disk 67 onto upper hoop disk 66 is much quicker than removing upper hoop disk 66, attaching lower hoop disk 67, making the run, then removing lower hoop disk 67, and re-attaching upper hoop disk 66.

Although FIG. 6 illustrates upper hoop disk 66 as having a larger diameter than lower hoop disk 67, it should be understood that the relative diameters of the two hoop disks can be varied without departing from the spirit of the invention. For example, lower hoop disk 67 could have a larger diameter than that of upper hoop disk 66.

FIG. 7 is a perspective view of an alternative embodiment of mechanical embroidery hooper 10. In this embodiment, connecting bar 70 is attached to the connecting rods of cylinder assemblies 15 and 15'. Hoop disk 22 attaches to the approximate middle of connecting bar 70 via attaching means 77. Base 17 is bolted to substrate 16, as in the preferred embodiment. Base 17 defines a recess 71, and a suitable spider (not shown) may be inserted within recess 71, and the outer ring of an embroidery hoop (not shown) can be inserted within the spider. Cylindrical assemblies 15 and 15' are operated in tandem to drive hoop disk 22 toward and away from recess 71. This embodiment facilitates the mechanical hooping of fabric, especially with oval hoops. With connecting bar 70 secured at both ends, the oval inner and outer rings will remain in proper registration and the entire hooping structure will have more stability, resulting in a higher completion rate.

FIG. 8 is a perspective view of another alternative embodiment of mechanical embroidery hooper 10. In this embodiment, hoop disk 82 is joined to the connecting rods of both cylindrical assemblies 15 and 15'. As in the preferred embodiment, base 17 is bolted to substrate 16. Base 17 defines recess 81. Cylindrical assemblies 15 and 15' are operated in tandem to drive hoop disk 82 toward and away from recess 81.

The embodiment illustrated in FIG. 8 is especially useful for framing fabric sections with elongated or oval embroidery hoops. With such hoops, it is important to apply equal pressure to both extremities of the hoop for even, secure framing. Thus, this alternative embodiment mounts the connecting rods of cylinder assemblies 15 and 15' near the extremities of hoop disk 82 so that they drive hoop disk 82 with equal pressure applied at both extremities.

With elongated or oval embroidery hoops, it is also important to prevent the inner hoop from rotating relative to the outer hoop during the framing process. For example, if hoop disk 82 were attached at some central point to a single cylindrical assembly 15, then it is mechanically possible for hoop disk 82 to rotate, however slightly, relative to recess 81. Then, the inner hoop and outer hoop will be mis-aligned, and the two hoops might bind or shatter if they are driven together. However, this alternative embodiment prevents such rotation by attaching hoop disk 82 at two points, rather than only one point. Thus, the likelihood of hoop disk 82 rotating even slightly relative to recess 81 is reduced, and the likelihood of the inner and outer hoops becoming mis-aligned also decreases.

Figure 9:
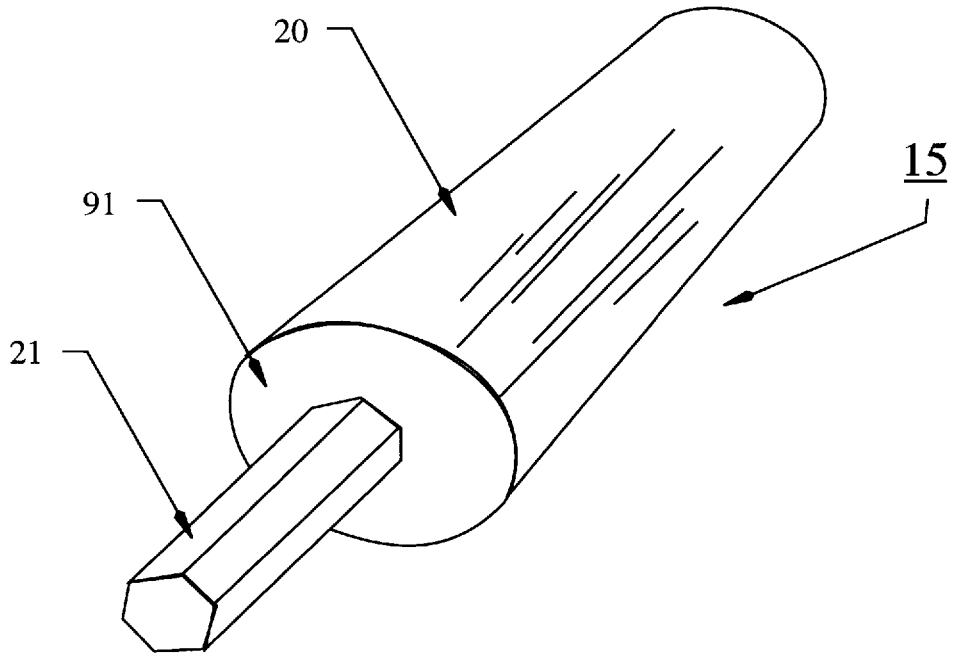
FIG. 9 is a perspective, fragmented view of the preferred embodiment of cylinder assembly 15.

FIG. 9 is a perspective, fragmented view of the preferred embodiment of cylinder assembly 15. As illustrated connecting rod 21 and cylinder housing 20 are coaxially positioned, and connecting rod 21 can extend and retract relative to cylinder housing 20. Connecting rod 21 is shown with a hexagonal cross sectional profile, and sidably passes through end 91 of cylinder housing 20. End 91 defines an aperture having a hexagonal shape, and this aperture is sized to fit connecting rod 21 snugly so that connecting rod 21 is effectively keyed to cylinder housing 20. Thus, connecting rod 21 cannot rotate about its axis relative to cylinder housing 20. This feature of mechanical embroidery hooper 10 is especially important when framing non-round embroidery hoops. With such embroidery hoops, any rotation of connecting rod 21 relative to cylinder housing 20 will mis-align the inner and outer rings of the embroidery hoop, and the two rings may bind or shatter when driven together.

Although FIG. 9 illustrates connecting rod 21 with a hexagonal cross section, it is possible to vary the cross-sectional profile of connecting rod 21 without departing from the spirit of the invention. Any cross-sectional profile that keys connecting rod 21 and cylinder housing 20 together to prevent connecting rod 21 from rotating axially relative to cylinder housing 20 is sufficient. For example, connecting rod 21 might be round, with one or more splines running along its length, and with end 91 defining an aperture matching the splines. Also, connecting rod 21 could be square or octagonal, with end 91 defining an aperture having a matching shape. In general, the shape of the aperture defined by end 91 should match the cross-sectional profile of connecting rod 21.

Figure 10:
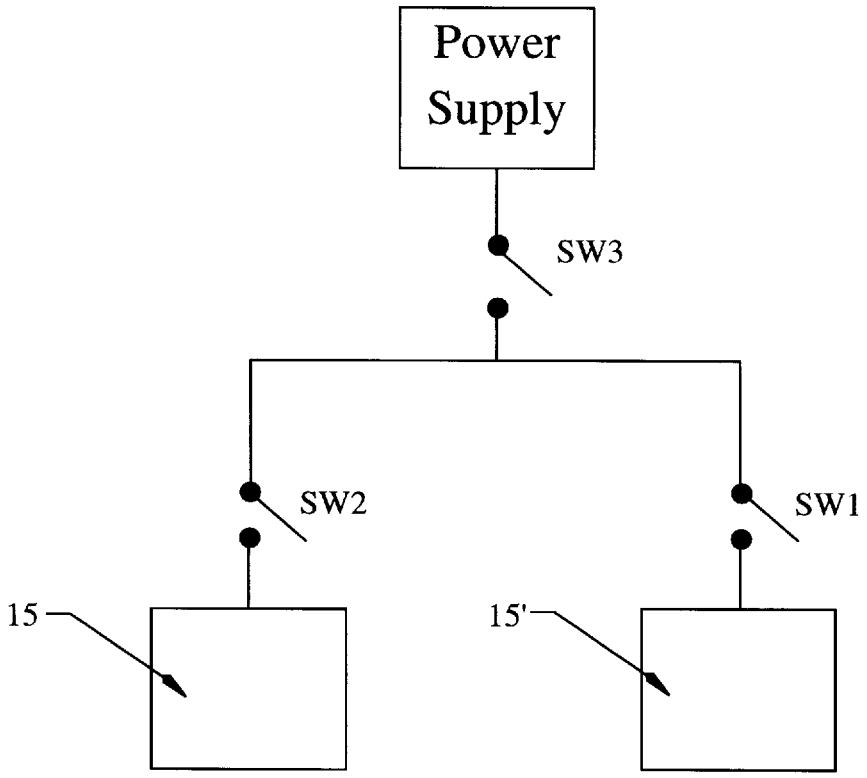
FIG. 10 is a block diagram of the switching system used to operate cylinder assemblies 15 and 15'.

FIG. 10 is a block diagram of the switching system used to allow cylinder assemblies 15 and 15' to operate either simultaneously or individually. Master switch SW3 is a conventional single pole switch with its feed terminal connected to a power supply. Two other conventional single pole switches, SW1 and SW2, have their feed terminals connected to the switched terminal of SW3. The switched terminal of SW1 feeds cylinder assembly 15, while the switched terminal of SW2 feeds cylinder assembly 15'. Master switch SW3 controls the overall operation of cylinder assemblies 15 and 15', while switches SW1 and SW2 control the individual operation of the two cylinder assemblies. When SW3 closes, power is supplied to SW1 and SW2. If SW1 is closed, then cylinder assembly 15 10 operates. If SW2 is closed, then cylinder assembly 15' operates. If both SW1 and SW2 are closed, then both cylinder assemblies operate in tandem.

The control circuit shown in FIG. 10 provides means for selectively operating cylinder assemblies 15 and 15' independently of one another. It should be understood that any control circuit having a master switch being connected in series to two other switches controlling the cylinder assemblies would also provide suitable means for selectively operating the cylinder assemblies.

It should be understood that the above description is made only by way of example, and is not intended to limit the scope of the invention. Certain modifications may be made to the invention without departing from the spirit of the invention, which is defined by the appended claims.

I claim:

1. A mechanical embroidery hooper for mounting fabric sections onto embroidery hoops, the hoops having a first ring and a second ring being engageable with the first ring, the mechanical hooper comprising:

(a) a base, the second rings being positionable on said base, and the fabric sections being positionable on the second rings;

(b) a means for detachably retaining the first rings;

(c) a first means, joined to said base, for driving said retaining means toward said base so that a first ring is driven into engagement with a second ring to allow the first ring to detach from the retaining means, thereby pressing a fabric section between the first ring and the second ring and thereby mounting a fabric section onto an embroidery hoop; and (e) a second means, joined to said base, for driving said retaining means toward said base so that a first ring is driven into engagement with a second ring to allow the first ring to detach from the retaining means, thereby pressing a fabric section between the first ring and the second ring and thereby mounting a fabric section onto an embroidery hoop, Whereby the first and second driving means are capable of being operated either independently to drive two separate retaining means or connectable to drive a single retaining means.

2. The hooper of claim 1, wherein each one of said driving means includes:

(a) a hollow elongated cylinder housing having a closed end, the closed end defining an aperture; and (b) a connecting rod slidably passing through the aperture and having a coaxial relationship to the cylinder housing, and wherein the hoop disk securing means are joined to the connecting rod.

3. The hooper of claim 2, wherein each one of the connecting rods is keyed to its corresponding aperture.

4. The hooper of claim 2, wherein each of the connecting rods has an octagonal cross section.

5. The hooper of claim 2, wherein each of the connecting rods has a hexagonal cross section.

6. The hooper of claim 2, wherein said base is generally planar, and wherein each one of said cylindrical assemblies are mounted so that the axes of the cylindrical housings are normal to the plane of said base.

7. The hooper of claim 1, wherein each one of said retaining means includes a hoop disk.

8. The hooper of claim 1, further comprising a means for securing the second rings to the base.

9. The hooper of claim 8, wherein said securing means includes a recess defined by said base, and wherein the second ring is positionable within the recess.

10. The hooper of claim 1, wherein said driving means are mounted in tandem upon said base.

11. The hooper of claim 1, wherein each of said driving means includes a pneumatically-operated cylinder.

12. The hooper of claim 1, further comprising means for selectively operating each one of said driving means independently of the other driving means.

13. The hooper of claim 12, wherein said operating means includes a switch being operatively connected to said pair of driving means.

14. The mechanical hooper of claim 1 wherein the driving means are connectably operated and drive a single first ring to engage a single second ring.

15. The mechanical hooper of claim 14 wherein said first and second ring are non-circular.

16. The mechanical hooper of claim 1 wherein the first and second driving means are operated independently and wherein the embroidery hoops engaged by the two driving means have different configurations.

17. A method of mechanically hooping at least two fabric sections onto at least two embroidery hoops, the method comprising the steps of:

(a) providing at least two embroidery hoops, each of the hoops having a first ring and a second ring, the first ring being engageable with the second ring; and each embroidery hoop having a different configuration from the other;

(b) placing each of the second rings upon a base of a mechanical press;

(c) positioning one each of the fabric sections upon one each of the second rings;

(d) attaching each of the first rings to a pair of hoop disks joined to the mechanical press, each hoop disk having a different configuration from the other;

(e) driving each of the first rings into engagement with the corresponding second ring using the mechanical press to thereby press one of the fabric sections between the first ring and the second ring; and (f) detaching each of first rings from the mechanical press, thereby hooping the sections of fabric onto the embroidery hoops.

18. The method of claim 17, wherein the step of driving the first rings includes driving the two first rings independently of one another.

19. The method of claim 17, wherein the step of providing at least two embroidery hoops includes providing a pair of embroidery hoops, each hoop having two engageable rings, each one of the rings having a vertical mating surface and a beveled corner adjoining the vertical mating surface.

20. The method of claim 17, wherein the step of placing the second ring includes placing the second ring into a recess defined by a base of the mechanical press.

21. A method of mechanically hooping a section of fabric onto a non-circular embroidery hoop, the method comprising the steps of:

(a) providing at least one non-circular embroidery hoop having a first ring and a second ring, the first ring being engageable with the second ring;

(b) placing the second ring upon a base of a mechanical press;

(c) positioning the fabric section upon the second ring;

(d) attaching the first ring to the mechanical press said mechanical press having at least two driving means connected together for driving said first ring with substantially equal force at two separate points, (e) driving the first ring into engagement with the second ring with the mechanical press to thereby mount the fabric section between the first ring and the second ring; and (f) allowing the first ring to detach from the mechanical press, thereby hooping the section of fabric onto the embroidery hoop.

22. The method of claim 21, wherein the step of attaching each of the first rings to the mechanical press includes attaching each of the first rings to a pair of hoop disks joined to the mechanical press.

* * * * *